US007405709B2

(12) United States Patent
Takahashi et al.

(10) Patent No.: US 7,405,709 B2
(45) Date of Patent: Jul. 29, 2008

(54) MAGNETIC CORE MEMBER, ANTENNA MODULE, AND MOBILE COMMUNICATION TERMINAL HAVING THE SAME

(75) Inventors: Isao Takahashi, Miyagi (JP); Kazuo Nozawa, Miyagi (JP); Hiraku Akiho, Miyagi (JP)

(73) Assignee: Sony Corporation, Tokyo (JP)

( * ) Notice: Subject to any disclaimer, the term of this patent is extended or adjusted under 35 U.S.C. 154(b) by 361 days.

(21) Appl. No.: 10/569,900

(22) PCT Filed: Aug. 27, 2004

(86) PCT No.: PCT/JP2004/012783

§ 371 (c)(1),
(2), (4) Date: Feb. 28, 2004

(87) PCT Pub. No.: WO2005/022687

PCT Pub. Date: Mar. 10, 2005

(65) Prior Publication Data

US 2007/0001921 A1 Jan. 4, 2007

(30) Foreign Application Priority Data

Sep. 1, 2003 (JP) ..... 2003-309366

(51) Int. Cl.
*H01Q 7/08* (2006.01)
*H01Q 1/36* (2006.01)

(52) U.S. Cl. ..... 343/788; 343/895

(58) Field of Classification Search ..... 343/787, 343/788, 866, 867, 895
See application file for complete search history.

(56) References Cited

U.S. PATENT DOCUMENTS

| | | | | |
|---|---|---|---|---|
| 5,625,366 | A * | 4/1997 | D'Hont | 343/718 |
| 5,638,080 | A * | 6/1997 | Orthmann et al. | 343/788 |
| 7,088,304 | B2 * | 8/2006 | Endo et al. | 343/788 |
| 2005/0162331 | A1 * | 7/2005 | Endo et al. | 343/788 |

FOREIGN PATENT DOCUMENTS

| | | |
|---|---|---|
| JP | 2001-156487 | 6/2001 |
| JP | 2001-331772 | 11/2001 |
| JP | 2002-94285 | 3/2002 |
| JP | 2002-344226 | 11/2002 |

* cited by examiner

*Primary Examiner*—Shih-Chao Chen
(74) *Attorney, Agent, or Firm*—Sonnenschein Nath & Rosenthal LLP

(57) ABSTRACT

A magnetic core member, an antenna module, and a portable communication terminal having this, which have a configuration capable of satisfying enhancement of communication characteristics of antenna coils as well as their sufficient electromagnetic shielding function from a shield plate. A magnetic core member (4) is disposed between an antenna substrate having antenna coils (11), (12) formed therein and a conductive shield plate (3), and is formed by filling an insulating material (30) with a magnetic powder (31). The magnetic core member (4) has a two-layered structure including a first layer (4A) and a second layer (4B), thereby making a filling rate of the magnetic powder (31) in the first layer (4A) be lower than that of the magnetic powder (31) in the second layer (4B) so that a first surface (4*a*) on a side opposed to the antenna substrate (2) and a second surface (4*b*) on a side opposed to the shield plate (3) have magnetic properties different from each other.

18 Claims, 14 Drawing Sheets

MAGNETIC CORE MEMBER, ANTENNA MODULE, AND MOBILE COMMUNICATION TERMINAL HAVING THE SAME

TECHNICAL FIELD

The present invention relates to a magnetic core member, an antenna module, and a portable communication terminal having this, adapted for use in IC tags using RFID (Radio Frequency Identification) technology.

BACKGROUND ART

Conventionally, as an IC card and an identification tag using RFID technology (these are hereinafter referred to collectively as "IC tag" as well), devices are known in which an IC chip having recorded information therein and a resonant capacitor are electrically connected to an antenna coil. In these devices, it is configured to implement identification or monitoring by transmitting an electric wave of a predetermined frequency from a transmission/reception antenna of a reader/writer to the antenna coil, to activate an IC tag, and then to read the information stored in the IC chip in accordance with a read command based on data communication via the electric wave, or depending on whether or not resonance occurs with the electric wave of the specific frequency. Additionally, many of IC cards are configured to be able to update the information read, and write history information.

As a conventional antenna module for use mainly as an identification tag, a device is available in which a magnetic core member is inserted into an antenna coil formed by spirally winding wire in a plane, so as to be substantially parallel to the plane of this antenna coil (see Japanese Patent Application Publication No. 2000-48152). The magnetic core member in this antenna module is made of an amorphous sheet or an electromagnetic steel strip. The magnetic core member is inserted into the antenna coil so as to be substantially parallel to the plane of the antenna coil, for reducing the thickness of the entire antenna module.

However, since the antenna module having the above-mentioned configuration has its magnetic core member made of an amorphous sheet or an electromagnetic steel strip, a Q factor usable for frequencies of about 100 kHz is obtainable, but for a case of a high frequency such as several MHz to several tens of MHz, there has been an inconvenience that its Q factor drops due to eddy currents occurring in the amorphous sheet or the electromagnetic steel strip of the magnetic core member. Particularly, in recent years, IC tags using the RFID technology operating at 13.56 MHz have come into practice, and the antenna module disclosed in Japanese Patent Application Publication No. 2000-48152 is not usable for tags operating in such high-frequency electric waves.

On the other hand, a sintered ferrite has hitherto been known as a magnetic core member usable at high frequencies. However, the sintered ferrite is comparatively fragile. Particularly, when a sintered ferrite plate is made thin for use as a magnetic core member in order to obtain a thin antenna coil, the magnetic core member is susceptible to breakage, thus imposing a handling quality problem that its actual usable environment is limited. In order to overcome this problem, an antenna coil has been proposed which has a relatively high rigidity and is designed to be usable at relatively high frequencies, by forming a magnetic core member of a composite material including soft magnetic metal, amorphous or ferrite powder or flakes, and a plastic or rubber (see Japanese Patent Application Publication No. 2002-325013).

Furthermore, Japanese Patent Application Publication No. 2000-113142 discloses an antenna module having a configuration in which an antenna coil is formed by spirally winding wire within a plane, and a flat-shaped magnetic core member is laminated thereon so as to be parallel to this antenna coil.

Furthermore, Japanese Patent Application Publication No. Hei 11-74140 discloses a dust core manufacturing method in which a metal powder, which is used as a choke coil magnetic core and which is made of a composite material, is aligned in a direction of extrusion during extrusion molding. Japanese Patent Application Publication No. 2002-289414 discloses a configuration using a composite magnetic body in which a flat metal powder is pressed onto an electric wave absorber for adhesion to the back or the like of a liquid crystal of a portable information terminal in order to satisfy a noise standard for 100-400 MHz.

By the way, in recent years, a reliable operating environment is needed for RFID-based IC tags operating at 13.56 MHz. For example, also in terms of their communication characteristics, the longest possible communication distance, as well as a flat, wide communication area for a reader/writer facing a tag are called for.

For example, in a case where an article to be identified is made of a metal, an antenna coil used as an identification tag has an electrically insulating spacer interposed between the antenna coil and the article in order to avoid influence by the article, and the spacer may be substituted for by a magnetic core member in some cases (see Japanese Patent Application Publication No. 2000-113142).

On the other hand, since there may be cases where an antenna coil is incorporated into various communication equipment, the antenna coil may be easily affected by a metallic part, even if it is not the article to be identified, positioned therearound. In order to avoid this, there is a device in which a shield plate is adhered to the back (surface for adhesion) of a communication surface to suppress fluctuations in communication characteristics caused by a metallic body (see Japanese Patent Application Publication No. 2002-325013).

Although the fluctuations in the communication characteristics can be prevented by the shield plate, this also means that the communication characteristics of the antenna coil are degraded to a certain level by the shield plate. Thus, from the viewpoint of enhancing the communication characteristics, the presence of the shield plate could be a serious negative factor.

To overcome this situation, in order to suppress degradation of the communication characteristics of an antenna coil due to the influence of surrounding metals, if an antenna module is configured such that the above-mentioned magnetic core member is interposed between the antenna coil and the shield plate, the shield plate can be made to function as if it were not present as viewed from the side of the antenna coil (Japanese Patent Application No. 2003-092893).

In an antenna module having a laminated structure including an antenna coil, a magnetic core member, and a shield plate, the magnetic core member in the middle performs both a function of allowing the antenna coil to exhibit its communication performance, and an electromagnetic shielding function of preventing the antenna coil from being affected by the shield plate.

However, magnetic properties required of the magnetic core member to allow the antenna coil to exhibit the required communication performance are not necessarily compatible with magnetic properties required of the magnetic core member to satisfy the electromagnetic shielding function between the antenna coil and the shield plate. Thus, the present situation calls for proper selection of a magnetic core member that can trade off the communication characteristics of the antenna coil against its electromagnetic shielding function from the shield plate.

The present invention has been made in view of the above circumstances, and therefore has an object to provide a magnetic core member, an antenna module, and a portable communication terminal having this, which has a configuration capable of satisfying enhancement of the communication characteristics of the antenna coil, as well as its electromagnetic shielding function from the shield plate.

DISCLOSURE OF THE INVENTION

In order to achieve the above object, in the present invention, a magnetic core member is characterized in that a first surface opposed to an antenna coil and a second surface opposed to a shield plate have magnetic properties different from each other.

Preferably, in the magnetic core member, it may be configured to make a filling rate of a magnetic powder in the first surface lower than a filling rate of the magnetic powder in the second surface, thereby making the first and second surfaces have magnetic properties different from each other. This permits, in the first surface, to increase its insulation to reduce coil loss and extend the communication distance, and, in the second surface, to obtain a sufficient electromagnetic function between the antenna coil and the shield plate.

Alternatively, similar advantages may be obtained if it is configured to align the magnetic powder in the first surface in a direction perpendicular to a sheet surface, and to align the magnetic powder in the second surface in parallel to the sheet surface, thereby making the first and second surfaces of the magnetic core member have magnetic properties different from each other.

Still alternatively, it may be configured to make the magnetic powder in the first surface and the magnetic powder in the second surface to differ in shape, thereby making the first and second surfaces of the magnetic core member have magnetic properties different from each other.

Even alternatively, if machined marks are formed in the first surface of the magnetic core member, magnetic paths in the first surface are split by the machined marks, to suppress eddy currents occurring in the first surface. This permits enhancement of the communication distance of the antenna coil. Likewise, by providing the first surface with irregularities, similar advantages can be obtained.

As mentioned above, according to the magnetic core member of the present invention, it becomes possible to satisfy enhancement of the communication distance of the antenna coil, as well as a sufficient electromagnetic shielding function between the antenna coil and the shield plate. This makes it possible to manufacture an antenna module having various communication characteristics with a high degree of freedom of design through arbitrary selection of magnetic properties for the antenna side and the shield side of the magnetic core member.

Furthermore, when an antenna module having such a configuration is incorporated in a portable communication terminal, it becomes possible to eliminate electromagnetic interference between the antenna coil and the communication terminal, and thus to ensure proper operation of the equipment.

BEST MODES FOR CARRYING OUT THE INVENTION

Embodiments of the present invention will be described below with reference to the drawings.

FIRST EMBODIMENT

Figure 1:
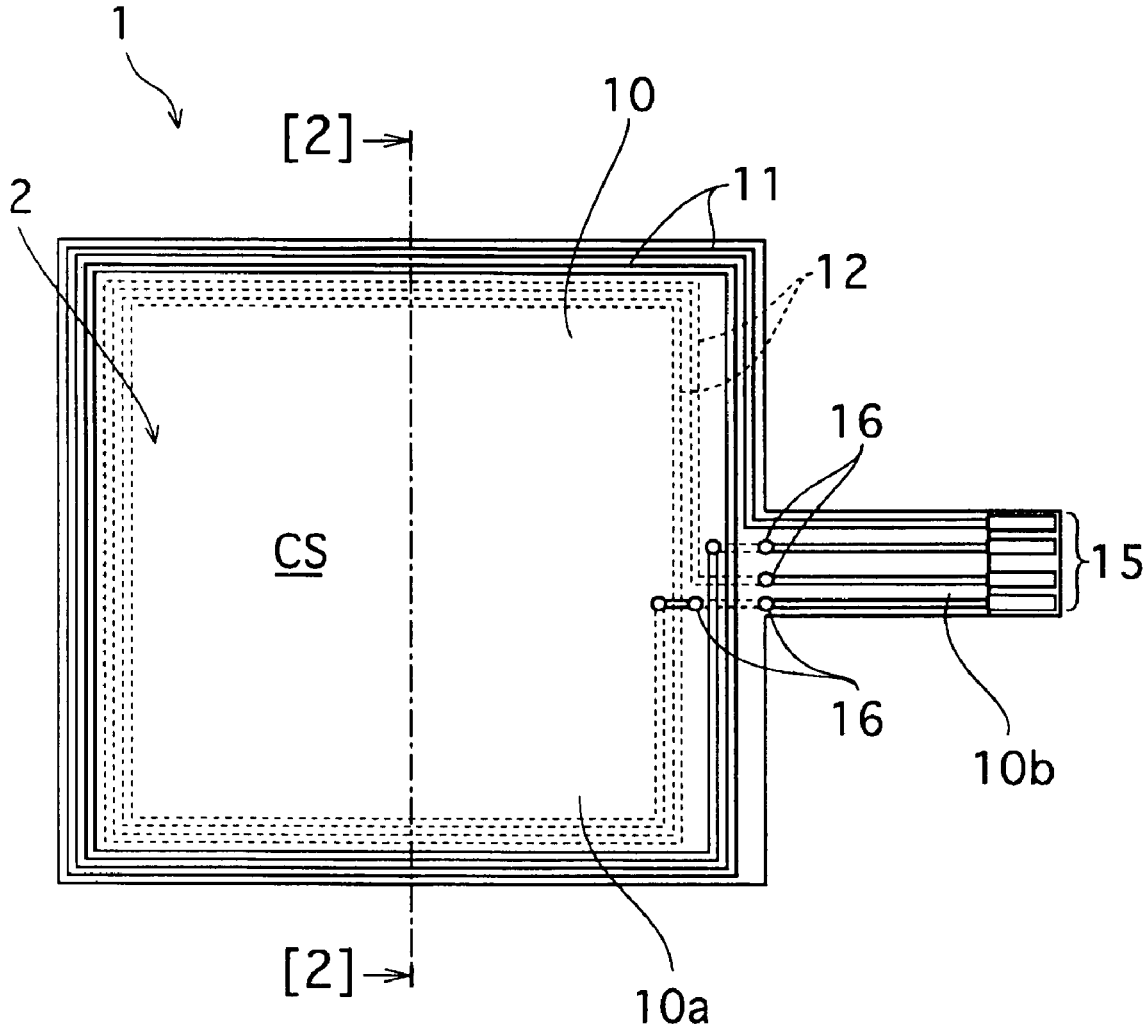
FIG. 1 is a plan view of an antenna module 1 according to a first embodiment of the present invention.
Figure 2:
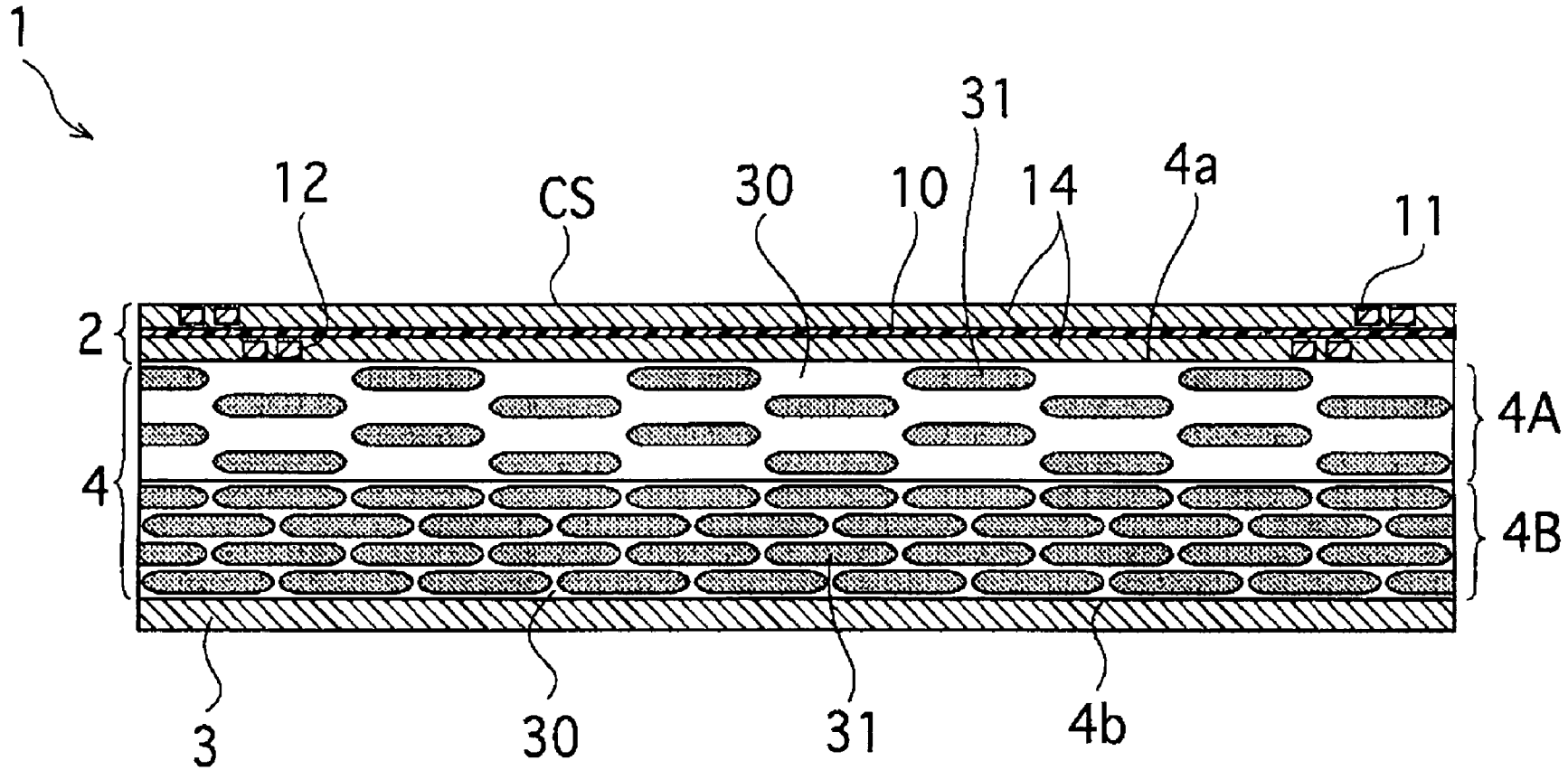
FIG. 2 is a schematic sectional view taken along a line [2]-[2] in FIG. 1.

FIGS. 1 and 2 show the configuration of an antenna module 1 according to a first embodiment of the present invention. Here, FIG. 1 is a plan view of the antenna module 1, and FIG. 2 is a sectional view taken along a line [2]-[2] in FIG. 1.

The antenna module 1 includes an antenna substrate 2 having first and second antenna coils 11, 12 formed therein, a shield plate 3, and a magnetic core member 4 disposed between the antenna substrate 2 and the shield plate 3.

In the antenna substrate 2, the first antenna coil 11 for communication with a reader/writer, and the second antenna coil 12 for communication with an IC tag, such as an IC card, are disposed and formed on a common base film 10. The first antenna coil 11 is disposed and formed on a surface side (communication surface CS) of the base film 10, and the second antenna coil 12 is disposed and formed on an rear-surface side (a side opposite to the communication surface CS) of the base film 10 (FIG. 2).

The base film 10 is formed of an insulating material. The base film 10 may be formed of a material having rigidity (a self-supporting property) such as a glass epoxy substrate, or a resin film having flexibility, such as polyimide, PET (PolyEthylene Terephthalate), PEN (PolyEthylene Naphthalate).

The base film 10 has a coil forming portion 10*a* of a large surface area on which the first antenna coil 11 and the second antenna coil 12 are formed, and a connecting portion 10*b* of a small surface area on which an external terminal connecting portion 15 for electrical connection with the termination of the first and second antenna coils 11, 12 is formed. The external terminal connecting portion 15 is also connected to terminals of an IC chip, terminals on a printed wiring board having the IC chip mounted thereon, or the like, all not shown.

It is noted that a reference numeral 16 in FIG. 1 denotes an interlayer connecting portion for electrically connecting both sides of the base film 10, through which the first and second antenna coils 11, 12 are connected at predetermined positions of the external terminal connecting portion 15. Moreover, overcoat members 14 made of an insulating material are also provided on both sides of the base film 10, respectively (FIG. 2).

Each of the first antenna coil 11 and the second antenna coil 12 is made of a conductive material which includes a thin film of a metal such as aluminum or copper, or a printed body of a conductive paste.

It is noted that the width, length, film thickness, or coating thickness, to be formed, of each of the antenna coils may be set suitably in accordance with communication performance required.

The first, second antenna coils 11, 12 are loop coils formed by winding wire in the plane of the base film 10. The positional relationship between the first antenna coil 11 and the second antenna coil 12 is not particularly limited. However, in the present embodiment, the second antenna coil 12 is disposed at an inner peripheral side of the first antenna coil 11.

The shield plate 3 and the magnetic core member 4 are laminated on the side opposite to the communication surface CS of the antenna substrate 2. The magnetic core member 4 is disposed between the antenna substrate 2 and the shield plate 3. The shield plate 3 and the magnetic core member 4 each are formed to a size substantially equal to the antenna substrate 2.

The shield plate 3 is formed of a conductive material and, when the antenna module 1 is incorporated into equipment such as a portable communication terminal, the shield plate 3 has a function of preventing electromagnetic interference between the antenna substrate 2 side and the communication terminal side. The shield plate 3 is formed of, e.g., a metal plate, such as a stainless steel plate, a copper plate, an aluminum plate.

On the other hand, the magnetic member 4 is formed by filling an insulating material such as, e.g., a synthetic resin material with a soft magnetic powder, and then by machining or molding it into a sheet. As the soft magnetic powder, Sendust (Fe—Al—Si base), permalloy (Fe—Ni) base, amorphous (Fe—Si—Al—B base), ferrite (NiZn ferrite, MnZn ferrite, and the like), sintered ferrite, and the like may be usable, and selectively used in accordance with intended communication characteristics or use.

By arranging such that the magnetic core member 4 is interposed between the antenna substrate 2 and the shield plate 3, there are advantages that degradation of communication performance due to electromagnetic interference between the antenna substrate 2 and the shield plate 3 can be avoided, as well as that a gap between the antenna substrate 2 and the shield plate 3 can be reduced.

Figure 3:
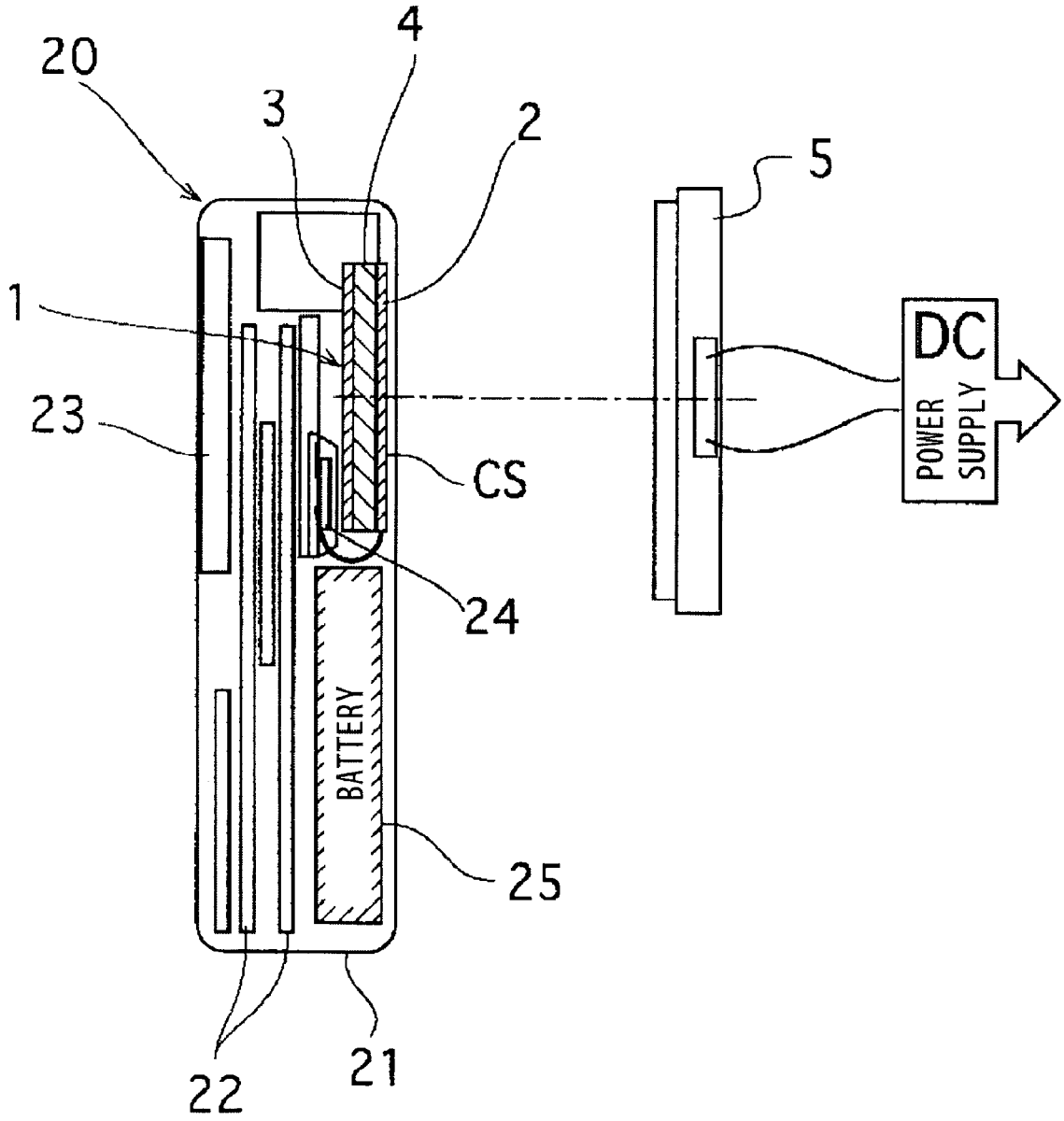
FIG. 3 is a schematic sectional view of a portable communication terminal incorporating the antenna module 1, showing an operation during communication with an external reader/writer 5.
Figure 4:
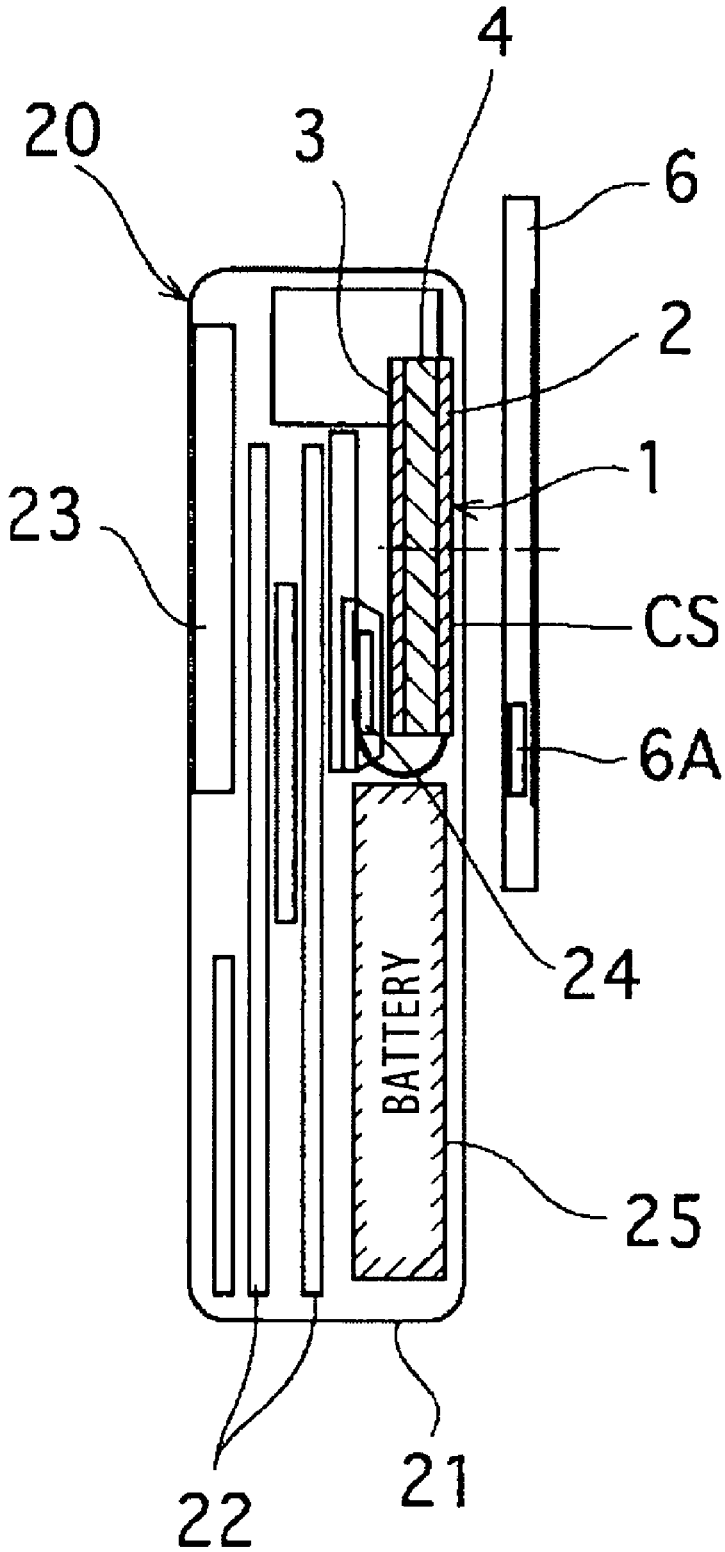
FIG. 4 is a schematic sectional view of the portable communication terminal incorporating the antenna module 1, showing an operation during communication with an external IC tag 6.

FIGS. 3 and 4 are schematic sectional views of a portable communication terminal 20 incorporating the antenna module 1. In the figures, an example is shown in which the antenna module 1 is disposed inside the upper rear surface side of a terminal body 21 of the portable communication terminal 20.

The terminal body 21 incorporates therein an electronic circuit board 22, and a battery 25. The electronic circuit board 22 has a CPU and other electronic components. The CPU serves to control various functions of the portable communication terminal 20 that has an information communication function to be performed via a communication network. Part of the surface side of the terminal body 21 is made up of a display section 23, such as a liquid crystal display. Moreover, although not shown, there are provided communicating means including a transmission/reception antenna necessary for exchanging information via the communication network, a control input section, a microphone and a speaker necessary for a telephone function, and the like.

The antenna module 1 is disposed inside the terminal body 21 with the communication surface CS of its antenna substrate 2 facing outward. At this time, the external terminal connecting portion 15 of the antenna substrate 2 is connected to, e.g., an IC chip 24 prepared for the antenna substrate 2.

The IC chip 24 stores an ID and other various information to be read when the portable communication terminal 20 is to communicate with an external reader/writer 5 via the first antenna coil 11. Also, this IC chip 24 stores an access procedure steps (program), key information and the like necessary for reading or writing information stored in an external IC tag 6 (an IC card, or the like; see FIG. 4) if necessary, when the portable communication terminal 20 is to communicate with the external IC tag 6 via the second antenna coil 12.

In the portable communication terminal 20 according to the present embodiment, as shown in FIG. 3, when the terminal 20 is to communicate with the external reader/writer 5, predetermined information stored in the IC chip 24 is transmitted via the first antenna coil 11 of the antenna substrate 2. Hence, e.g., transportation fares can be paid by utilizing a tag function of this portable communication terminal 20.

Moreover, as shown in FIG. 4, when the terminal 20 is to communicate with the external IC tag 6, predetermined information stored in an IC chip 6A within the IC tag 6 is read via the second antenna coil 12 of the antenna substrate 2. Hence, e.g., information such as the balance for the IC tag 6 can be checked via the display section 23 by utilizing a reader/writer function of this portable communication terminal 20.

It is noted that as a power supply for the time utilizing the reader/writer function, the battery 25 of the portable communication terminal 20 is used. In this case, an optimized design of the first, second antenna coils 11, 12 may contribute to a reduction of power consumption of the portable communication terminal 20.

Now, in the antenna module 1 disposed inside the portable communication terminal 20, the shield plate 3 performs an electromagnetic shielding function between the antenna substrate 2 and the electronic circuit board 22, thereby preventing electromagnetic interference between the portable communication terminal 20 and the antenna substrate 2. This prevents unwanted radiations (noises) occurring during communication via the first, second antenna coils 11, 12 from adversely affecting the electronic circuit board 22.

Moreover, the magnetic core member 4 has functions of both enhancing the communication performance of the antenna substrate 2, and suppressing electromagnetic interference between the antenna substrate 2 and the shield plate 3.

Details of the configuration of the magnetic core member 4 will be described below with reference to FIG. 2.

The magnetic core member 4 has a two-layered structure including a first layer 4A on the side of the antenna substrate 2, and a second layer 4B on the side of the shield plate 3.

Each of the first layer 4A and the second layer 4B of the magnetic core member 4 is formed by filling an insulating material (binder) 30, such as a synthetic resin, with a soft magnetic powder 31. The soft magnetic powder 31 is aligned parallel to the sheet surface. While flat magnetic particles are used as the soft magnetic powder 31 in the present embodiment, needle-shaped, flake-shaped magnetic particles or the like may also be usable.

In the present embodiment, the filling rate of the soft magnetic powder 31 is made to differ between the first layer 4A and the second layer 4B, thereby configuring such that a first surface 4*a* on a side opposed to the antenna substrate 2 and a second surface 4*b* on a side opposed to the shield plate 3 have magnetic properties different from each other, in the magnetic core member 4.

That is, amounts of the soft magnetic powder 31 for filling are adjusted for the first layer 4A and the second layer 4B such that the filling rate of the soft magnetic powder 31 in the first surface 4*a* becomes lower than the filling rate of the soft magnetic powder 31 in the second surface 4*b*, in the magnetic core member 4.

As a result of this configuration, in the first layer 4A where the filling rate of the soft magnetic powder 31 is lower, the insulating material 30 takes up a relatively large presence due to the lower filling rate of the soft magnetic powder 31, and thus insulation in the first surface 4*a* is increased. As a result, occurrence of eddy currents in the first surface 4*a* is suppressed to facilitate flow of currents induced in the antenna coil 11 (12), and hence to reduce coil loss (increase the Q factor). Therefore, a voltage induced in the antenna coil 11 (12) is increased to increase power to be supplied to the IC chip 24, thereby extending the communication distance of the antenna coils.

Figure 5:
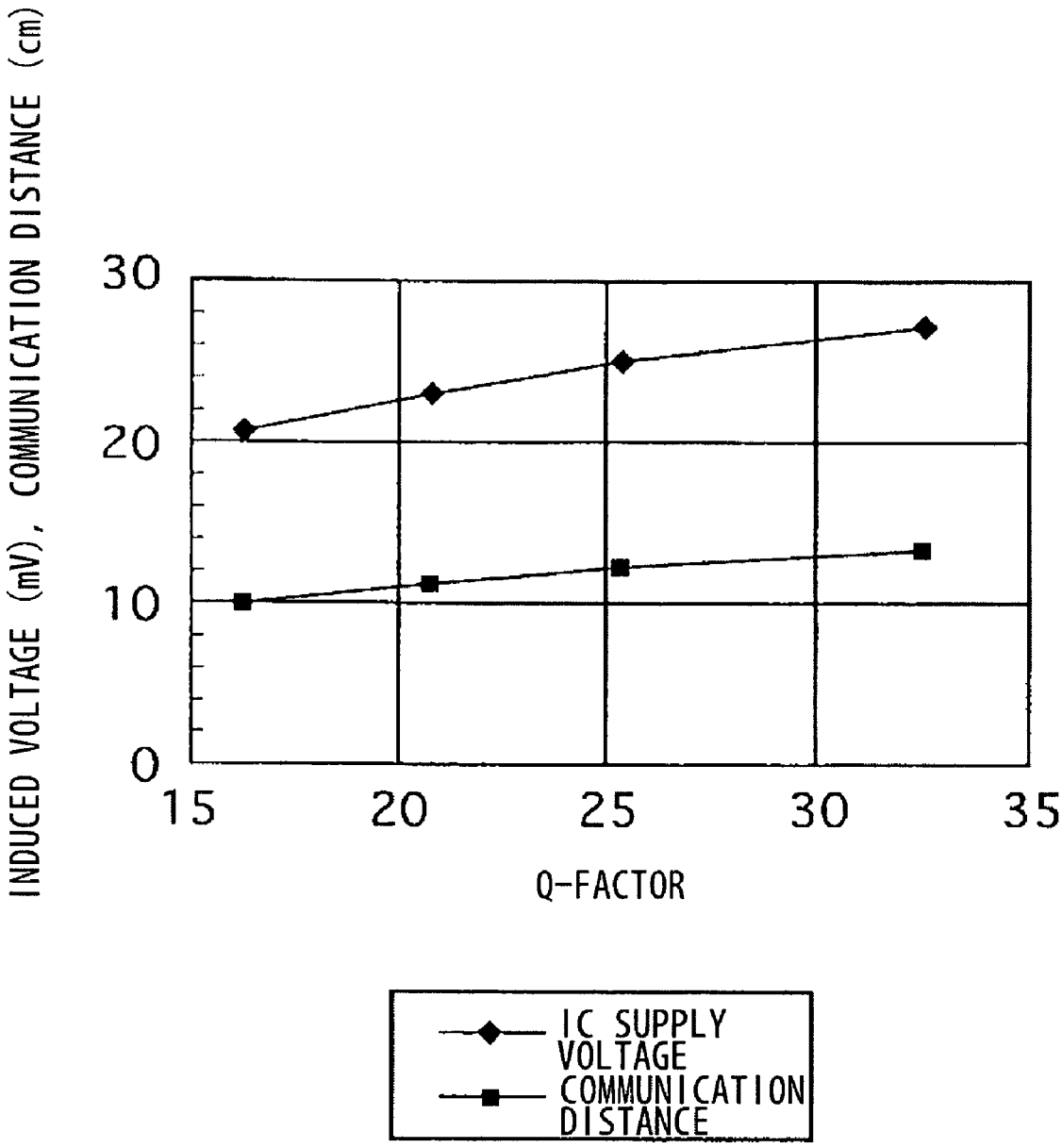
FIG. 5 is a diagram showing the Q factor versus the induced voltage and communication distance of an antenna coil in a contactless IC card.

FIG. 5 shows the relationship between the Q factor (an amount representing the sharpness of resonance; it is otherwise referred to simply as "Q") and the induced voltage and communication distance of an antenna coil of a typical contactless IC card. It is seen from FIG. 5 that the voltage to be supplied to the IC chip as well as the communication distance increase with increasing Q factor of the antenna coil.

On the other hand, in the second layer 4B where the filling rate of the soft magnetic powder 31 is higher, efficiency with which the shield plate 3 is covered with the soft magnetic powder 31 for filling becomes high, and thus the electromagnetic shielding function between the antenna substrate 2 and the shield plate 3 can be enhanced, and degradation of the communication performance of the antenna coils 11, 12 can hence be reduced.

Moreover, as viewed from the antenna coils 11, 12, the filling rate of the soft magnetic powder 31 in the second layer 4B is high, and the soft magnetic powder 31 is aligned in a direction of magnetization, facilitating passage of magnetic flux through the layer 4B (permeability is high). This increases the inductances of the antenna coils 11, 12, thereby enhancing the communication distance.

As mentioned above, according to the present embodiment, the filling rate of the soft magnetic powder 31 in the first surface 4*a* is made lower than the filling rate of the soft magnetic powder 31 in the second surface 4*b*, in the magnetic core member 4, to provide a structure in which the first and second surfaces 4*a*, 4*b* have magnetic properties different from each other. Therefore, it becomes possible to implement enhancement of the communication distance of the antenna coils 11, 12, as well as obtain a sufficient electromagnetic shielding function between the antenna coils 11, 12 and the shield plate 3.

It is noted that the magnetic core member 4 having the above configuration may be formed, e.g., of a laminated film having a plurality of coats of a magnetic coating material for forming the first layer 4A and a magnetic coating material for forming the second layer 4B, or by sticking a magnetic sheet formed of the first layer 4A and a magnetic sheet formed of the second layer 4B together.

It is further noted that the filling rate of the soft magnetic powder 31 in each of the first, second layers 4A, 4B is not to be uniquely defined, but may be set suitably in accordance with factors, such as the magnetic properties derived from the kind, shape, or the like of a magnetic powder to be used, the required communication performance of the antenna coils, and the like.

Furthermore, the soft magnetic powders 31 used for the first, second layers 4A, 4B are not limited to the same kind, but may be of different kinds as well.

SECOND EMBODIMENT

Figure 6:
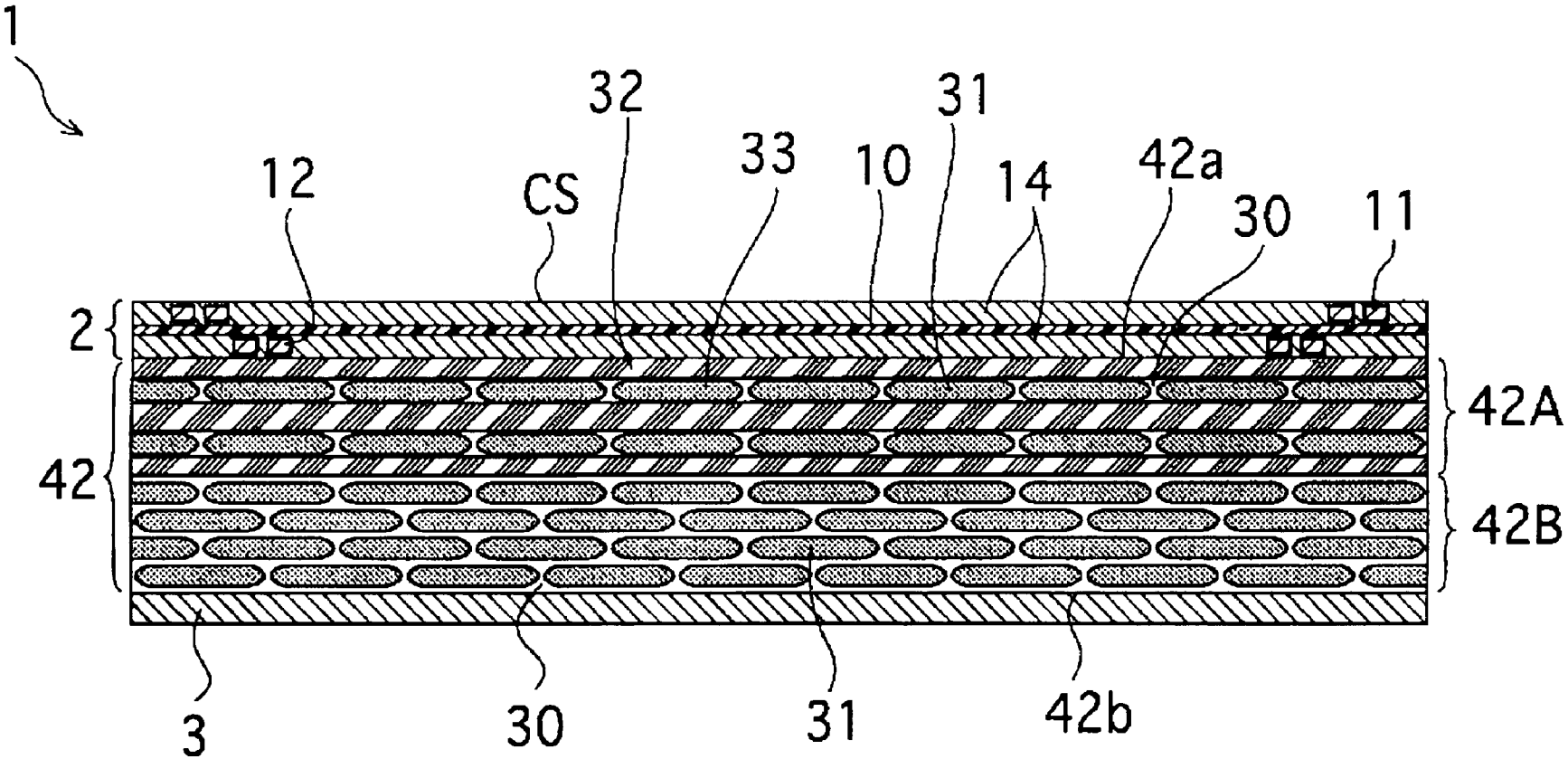
FIG. 6 is a schematic sectional view of an antenna module 1 for explaining a second embodiment of the present invention.

Referring next to FIG. 6, the configuration of an antenna module in a second embodiment of the present invention will be described. Note that in the figure, portions corresponding to those of the first embodiment are denoted by the same reference symbols, and that their detailed descriptions are omitted.

A magnetic core member 42 forming an antenna module 1 according to the present embodiment has a two-layered structure including a first layer 42A on the side of an antenna substrate 2 and a second layer 42B on the side of a shield plate 3.

Each of the first layer 42A and the second layer 42B of the magnetic core member 42 is formed by filling an insulating material (binder) 30, such as a synthetic resin, with a soft magnetic powder 31. The soft magnetic powder 31 is aligned parallel to the sheet surface.

In the present embodiment, similarly to the above-mentioned first embodiment, the filling rate of the soft magnetic powder 31 is made to differ between the first layer 42A and the second layer 42B, thereby configuring such that a first surface 42*a* opposed to the antenna substrate 2 and a second surface 42*b* opposed to the shield plate 3, of the magnetic core member 42 have magnetic properties different from each other.

That is, amounts of the soft magnetic powder 31 for filling are adjusted for the first layer 42A and the second layer 42B such that the filling rate of the soft magnetic powder 31 in the first surface 42*a* becomes lower than the filling rate of the soft magnetic powder 31 in the second surface 42*b*, in the magnetic core member 42.

Now, in the present embodiment, the first layer 42A has a composite layer configuration including a plurality of insulating layers 32 and magnetic layers 33 each being laminated alternately one upon another, thereby making its filling rate of the soft magnetic powder 31 lower than that of the second layer 42B. The magnetic layer 33 is formed by filling the insulating material 30 with the soft magnetic powder 31.

As a result of this configuration, in the first layer 42A where the filling rate of the soft magnetic powder 31 is lower, the insulating material 30 takes up a relatively large presence due to the lower filling rate of the soft magnetic powder 31, and thus, insulation in the first surface 42*a* is increased. As a result, occurrence of eddy currents in the first surface 4*a* is suppressed to facilitate flow of currents induced in the antenna coil 11 (12), and hence to reduce coil loss (increase the Q factor). Therefore, a voltage induced in the antenna coil 11 (12) is increased to increase power to be supplied to the IC chip 24, thereby extending the communication distance of the antenna coils.

On the other hand, in the second layer 42B where the filling rate of the soft magnetic powder 31 is higher, efficiency with which the shield plate 3 is covered with the soft magnetic powder 31 for filling becomes high, and thus the electromagnetic shielding function between the antenna substrate 2 and the shield plate 3 can be enhanced, and degradation of the communication performance of the antenna coils 11, 12 can hence be reduced.

Moreover, as viewed from the antenna coils 11, 12, the filling rate of the soft magnetic powder 31 in the second layer 4B is higher, and the soft magnetic powder 31 is aligned in a direction of magnetization, facilitating passage of magnetic flux through the layer 42B (permeability is high). This increases the inductances of the antenna coils 11, 12, thereby implementing enhancement of the communication distance.

As mentioned above, according to the present embodiment, the filling rate of the soft magnetic powder 31 in the first surface 42*a* is made lower than the filling rate of the soft magnetic powder 31 in the second surface 42*b*, in the magnetic core member 42, to provide a structure in which the first and second surfaces 42*a*, 42*b* have magnetic properties different from each other. Therefore, it becomes possible to implement enhancement of the communication distance of the antenna coils 11, 12, as well as to obtain a sufficient electromagnetic shielding function between the antenna coils 11, 12 and the shield plate 3.

Furthermore, according to the present embodiment, the filling rate of the soft magnetic powder 31 in the first layer 42A of the magnetic core member 42 can be adjusted arbitrarily by the thickness and the number of laminated layers of the insulating layers 33, and thus the magnetic layers 33 can be made to have the same configuration as the second layer 42B.

It is noted that the first layer 42A of the magnetic core member 42 having the above configuration may be formed of, e.g., a laminated film having a plurality of coats of a coating material for forming the insulating layers 32 and a magnetic coating material for forming the magnetic layers 33.

It is further noted that the filling rate of the soft magnetic powder 31 in each of the first, second layers 42A, 42B is not to be uniquely defined, but may be set suitably in accordance with factors, such as the magnetic properties derived from the kind, shape, or the like of a magnetic powder to be applied, the required communication performance of the antenna coils, and the like.

THIRD EMBODIMENT

Figure 7:
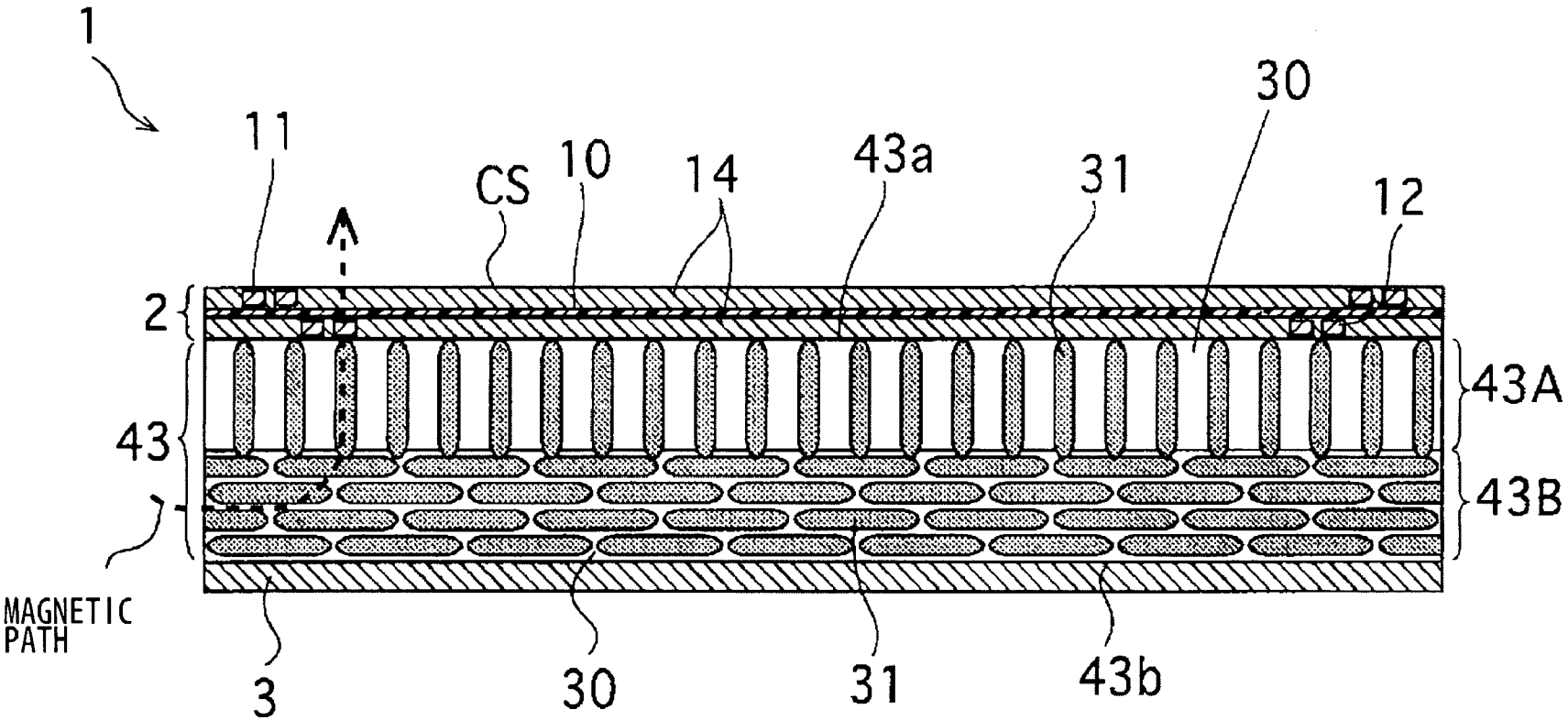
FIG. 7 is a schematic sectional view of an antenna module 1 for explaining a third embodiment of the present invention.

FIG. 7 shows the configuration of an antenna module in a third embodiment of the present invention. It is noted that in the figure, portions corresponding to those of the above-mentioned first embodiment are denoted by the same reference symbols, and that their detailed descriptions are omitted.

A magnetic core member 43 forming an antenna module 1 according to the present embodiment has a two-layered structure including a first layer 43A on the side of an antenna substrate 2 and a second layer 43B on the side of a shield plate 3. Each of the first layer 43A and the second layer 43B of the magnetic core member 43 is formed by filling an insulating material (binder) 30, such as a synthetic resin, with a soft magnetic powder 31.

In the present embodiment, the soft magnetic powders 31 in a first surface 43*a* opposed to the antenna substrate 2 and a second surface 43*b* opposed to the shield plate 3, of the magnetic core member 43, are aligned differently from each other, thereby configuring such that the first, second surfaces 43*a*, 43*b* have magnetic properties different from each other.

That is, the soft magnetic powder 31 in the first surface 43*a* of the magnetic core member 43 is aligned in a direction perpendicular to the sheet surface, whereas the soft magnetic powder 31 in the second surface 43*b* is aligned parallel to the sheet surface.

As a result of this configuration, in the first layer 43A where the soft magnetic powder 31 is aligned in a direction perpendicular to the sheet surface, the soft magnetic powder 31 is aligned substantially in the same direction as a direction of magnetization by electromagnetic waves generated by the antenna coils 11, 12, facilitating passage of magnetic flux through the layer 43A. Consequently, it becomes possible to extend the communication distance.

On the other hand, in the second layer 43B, efficiency with which the shield plate 3 is covered with the soft magnetic powder 31 for filling becomes high, and thus the electromagnetic shielding function between the antenna substrate 2 and the shield plate 3 can be enhanced, and degradation of the communication performance of the antenna coils 11, 12 can hence be reduced.

Moreover, as viewed from the antenna coils 11, 12, the soft magnetic powder 31 in the second layer 43B is aligned in a direction parallel to the sheet surface, the soft magnetic powder 31 is aligned substantially in the same direction as a direction of looping the electromagnetic waves generated by the antenna coils 11, 12, facilitating passage of magnetic flux through the layer 43B, which thus contributes to enhancing the communication distance of the antenna coils 11, 12.

As mentioned above, according to the present embodiment, the soft magnetic powder 31 is aligned in a direction perpendicular to the sheet surface in the first surface 43*a*, and the soft magnetic powder 31 is aligned in a direction parallel to the sheet surface in the second surface 43*b*, in the magnetic core member 43, to provide a structure in which the first and second surfaces 43*a*, 43*b* have magnetic properties different from each other. Therefore, it is possible to implement enhancement of the communication distance of the antenna coils 11, 12, as well as to obtain a sufficient electromagnetic shielding function between the antenna coils 11, 12 and the shield plate 3.

It is noted that the first layer 43A of the magnetic core member 43 having the above configuration may be formed such that the soft magnetic powder is aligned in the direction shown in the figure by, e.g., forming a film using a magnetic coating material for forming the first layer 43A, and thereafter by, e.g., hardening the film while externally magnetizing the film in a direction perpendicular to the sheet surface.

FOURTH EMBODIMENT

Figure 8:
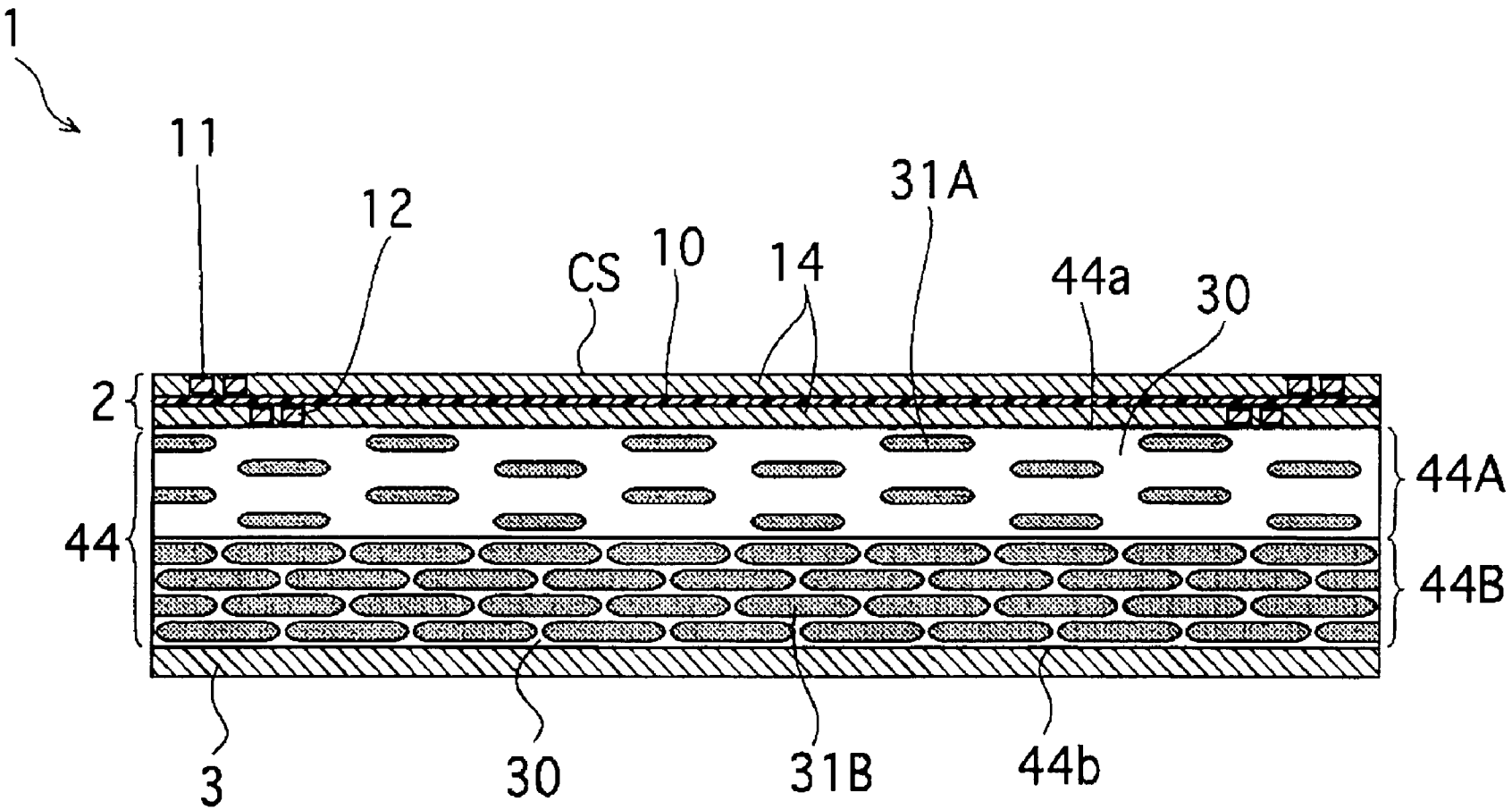
FIG. 8 is a schematic sectional view of an antenna module 1 for explaining a fourth embodiment of the present invention.

FIG. 8 shows the configuration of an antenna module in a fourth embodiment of the present invention. It is noted that in the figure, portions corresponding to those of the above-mentioned first embodiment are denoted by the same reference symbols, and that their detailed descriptions are omitted.

A magnetic core member 44 forming an antenna module 1 according to the present embodiment has a two-layered structure including a first layer 44A on the side of an antenna substrate 2 and a second layer 44B on the side of a shield plate 3. The first layer 44A and the second layer 44B of the magnetic core member 44 are formed by filling an insulating material (binder) 30, such as a synthetic resin, with a soft magnetic powder 31A and a soft magnetic powder 31B (each composed of flat particles), respectively. Each of these soft magnetic powders 31A, 31B is aligned parallel to the sheet surface.

The soft magnetic powder 31A and the soft magnetic powder 31B are different from each other in shape, and by forming the first, second layers 44A, 44B of the soft magnetic powders 31A, 31B having different shapes, it is configured such that a first surface 44*a* opposed to the antenna substrate 2 and a second surface 44*b* opposed to the shield plate 3 have magnetic properties different from each other, in the magnetic core member 44.

Now, in the present embodiment, the soft magnetic powder 31A for filling the first layer 44A has a small particle diameter (e.g., 40 μm or less), to suppress occurrence of eddy currents in the first surface 44*a* to facilitate flow of currents induced in the antenna coils 11, 12, and to reduce coil loss. This permits enhancement of the Q factor of the antenna coils 11, 12, and extension of their communication distance.

On the other hand, the soft magnetic powder 31B for filling the second layer 44B has a large particle diameter (e.g., 60 μm or more), to enhance the permeability of the second surface 44*b* and enhance the electromagnetic shielding function between the antenna substrate 2 and the shield plate 3, and also to facilitate passage of magnetic flux generated by the antenna coils 11, 12 through the surface 44*b* to enhance the communication distance.

It is noted that, as shown in the figure, the filling rate of the soft magnetic powder is made to differ between the first, second layers 44A, 44B as in the above-mentioned first embodiment (the filling rate of the soft magnetic powder 31A<the filling rate of the soft magnetic powder 31B), but is not to be limited thereto. Moreover, depending on the required communication performance, the particle diameter of the soft magnetic powder 31A in the first layer 44A may be made larger than the particle diameter of the soft magnetic powder 31B in the second layer 44B.

FIFTH EMBODIMENT

Figure 9:
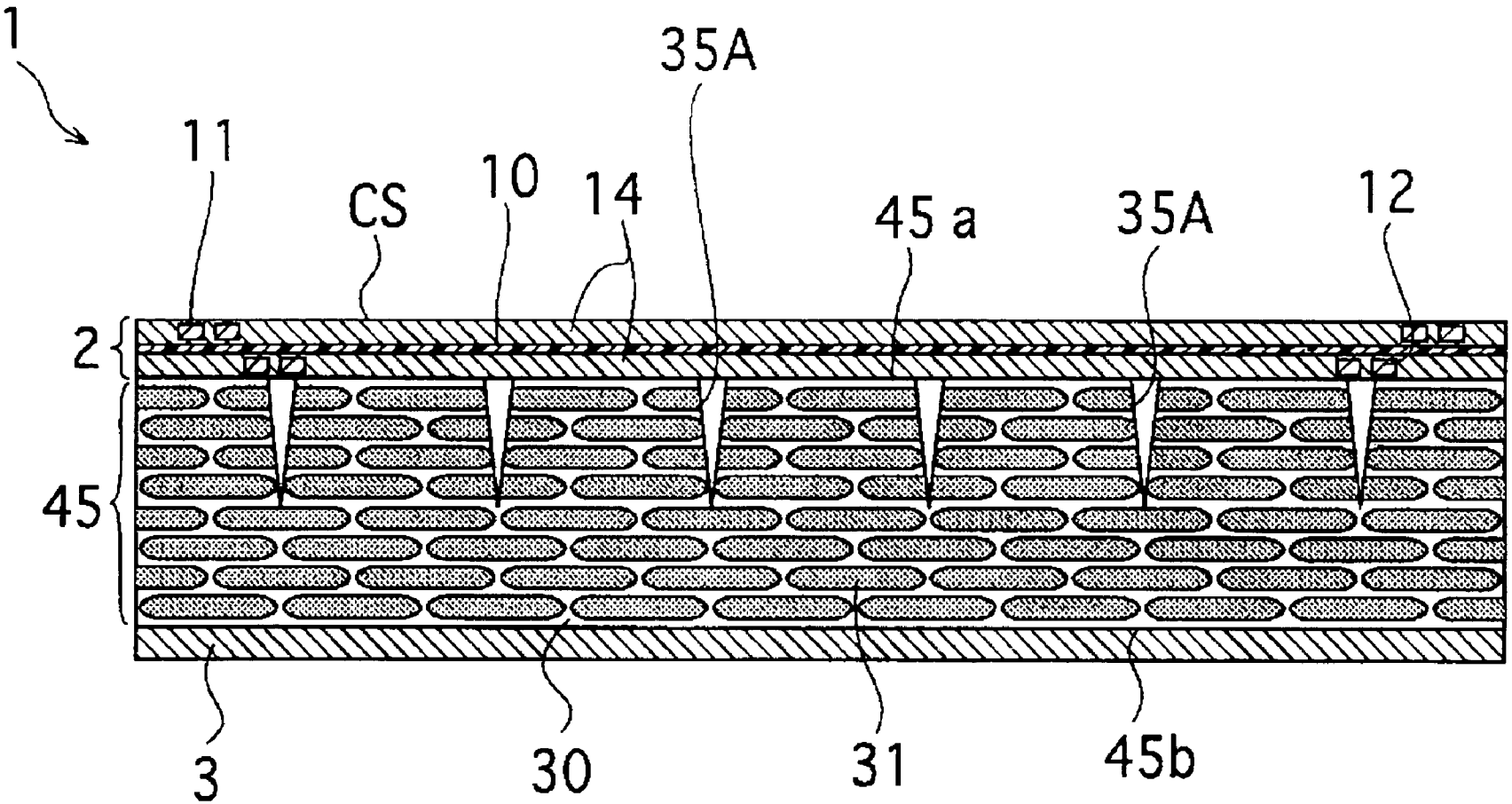
FIG. 9 is a schematic sectional view of an antenna module 1 for explaining a fifth embodiment of the present invention.

FIG. 9 shows the configuration of an antenna module in a fifth embodiment of the present invention. Note that in the figure, portions corresponding to those of the above-mentioned first embodiment are denoted by the same reference symbols, and that their detailed descriptions are omitted.

A magnetic core member 45 forming an antenna module 1 according to the present embodiment is formed by filling an insulating material (binder) 30, such as a synthetic resin, with a soft magnetic powder 31. Flat magnetic particles are used as the soft magnetic powder 31, and are aligned parallel to the sheet surface.

The magnetic core member 45 is formed such that a first surface 45*a* opposed to an antenna substrate 2 has machined marks formed therein, thereby configuring such that the first surface and a flat second surface 45*b* on a side opposed to a shield plate 3 have magnetic properties different from each other. In the present embodiment, the above-mentioned machined marks are substantially V-shaped slits 35A arranged in a matrix-shaped or grill-shaped pattern over the first surface 45*a* of the magnetic core member 45.

By forming the slits 35A in the first surface 45*a* of the magnetic core member 45, magnetic paths in the first surface 45*a* are split. This permits suppression of occurrence of eddy currents over the surface of the magnetic core member due to the formation of the magnetic paths, thereby reducing eddy-current loss. As a result, insulation in the first surface 45*a* is enhanced, and also flow of currents induced in the antenna coils 11, 12 is facilitated, thereby reducing coil loss (the Q factor is enhanced), and it thus becomes possible to extend the communication distance.

Requirements for the formation of the slits 35A, such as their aperture width, their depth, interval (pitch) to be formed, may be set suitably in accordance with the communication frequency, the kind, filling rate of a soft magnetic powder for filling, and the like. Note that the permeability of the surface can be maintained higher as an aperture width being narrower.

On the other hand, by making the second surface 45*b* of the magnetic core member 45 flat, the effect of covering the shield plate 3 with the soft magnetic powder 31 is enhanced, and the electromagnetic shielding function between the antenna substrate 2 and the shield plate 3 is ensured.

As mentioned above, according to the present embodiment, machined marks, which are the slits 35A, are formed in the first surface 45*a* of the magnetic core member 45, to provide a structure in which the first, second surfaces have magnetic properties different from each other. Therefore, it becomes possible to implement enhancement of the communication distance of the antenna coils 11, 12, as well as to obtain a sufficient electromagnetic shielding function between the antenna coils 11, 12 and the shield plate 3.

Figure 10:
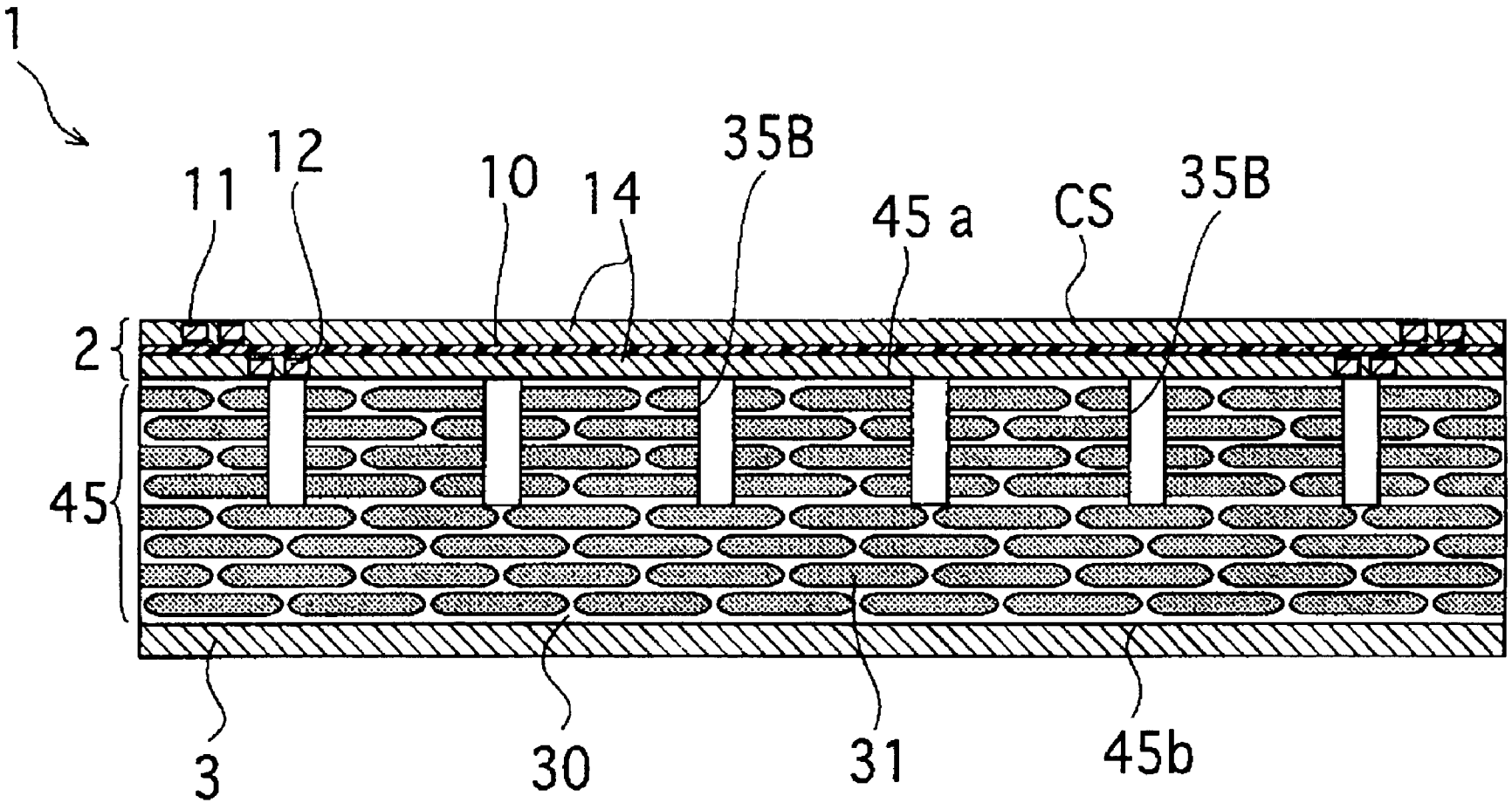
FIG. 10 is a schematic sectional view of an antenna module 1 showing a modified example of FIG. 9.

Note that the machined marks are not limited to the slits 35A having the above-mentioned configuration, but may include grooves 35B having an angled cross section such as shown in, e.g., FIG. 10. Moreover, how the slits 35A (grooves 35B) are arranged is not limited to the matrix-shaped or grill-shaped pattern mentioned above. Furthermore, the slits 35A (grooves 35B) may be formed by a known machining method, such as cutting, laser-machining, etching. The slits 35A (grooves 35B) may be filled with a different insulating material.

SIXTH EMBODIMENT

Figure 11:
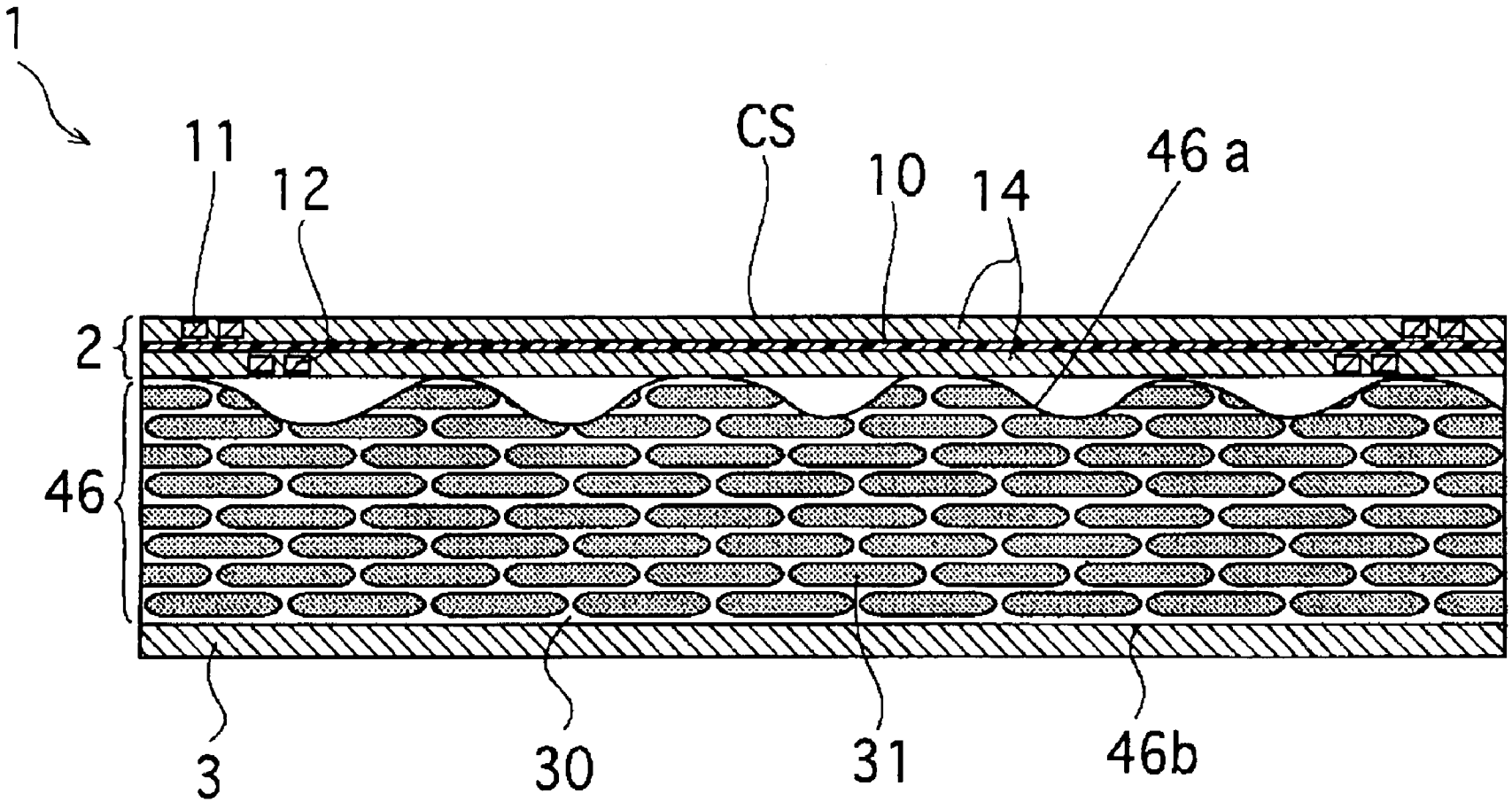
FIG. 11 is a schematic sectional view of an antenna module 1 for explaining a sixth embodiment of the present invention.

FIG. 11 shows the configuration of an antenna module in a sixth embodiment of the present invention. Note that in the figure, portions corresponding to those of the above-mentioned first embodiment are denoted by the same reference symbols, and that their detailed descriptions are omitted.

A magnetic core member 46 forming an antenna module 1 according to the present embodiment is formed by filling an insulating material (binder) 30, such as a synthetic resin, with a soft magnetic powder 31. Flat magnetic particles are used as the soft magnetic powder 31, and are aligned parallel to the sheet surface.

The magnetic core member 46 is formed such that a first surface 46*a* opposed to an antenna substrate 2 has irregularities in the form of depressions and projections, whereby it is configured such that the first surface and a flat second surface 46*b* on a side opposed to a shield plate 3 have magnetic properties different from each other. In the present embodiment, the first surface 45*a* is formed into a wavy, irregular surface.

By making the first surface 46*a* of the magnetic core member 46 to have irregularities in the form of depressions and projections, magnetic paths in the first surface 46*a* are split by the depressions. This permits suppression of occurrence of eddy currents over the surface of the magnetic core member due to the formation of the magnetic paths, to reduce eddy-current loss. As a result, insulation in the first surface 46*a* is enhanced, and also flow of currents induced in the antenna coils 11, 12 is facilitated, thereby reducing coil loss (the Q factor is enhanced), and it thus becomes possible to extend the communication distance.

Requirements for their formation, such as amounts of the depressions (projections), widths of the depressions (projections), pitch between a depression and a projection, may be set suitably in accordance with the communication frequency, the kind, filling rate of a soft magnetic powder for filling, and the like.

On the other hand, by making the second surface 46*b* of the magnetic core member 46 flat, the effect of covering the shield plate 3 with the soft magnetic powder 31 is enhanced, and the electromagnetic shielding function between the antenna substrate 2 and the shield plate 3 is ensured.

As mentioned above, according to the present embodiment, the first surface 46*a* of the magnetic core member 46 is provided with irregularities in the form of depressions and projections, to provide a structure in which the first, second surfaces have magnetic properties different from each other. Therefore, it becomes possible to implement enhancement of the communication distance of the antenna coils 11, 12, as well as obtain a sufficient electromagnetic shielding function between the antenna coils 11, 12 and the shield plate 3.

Figure 12:
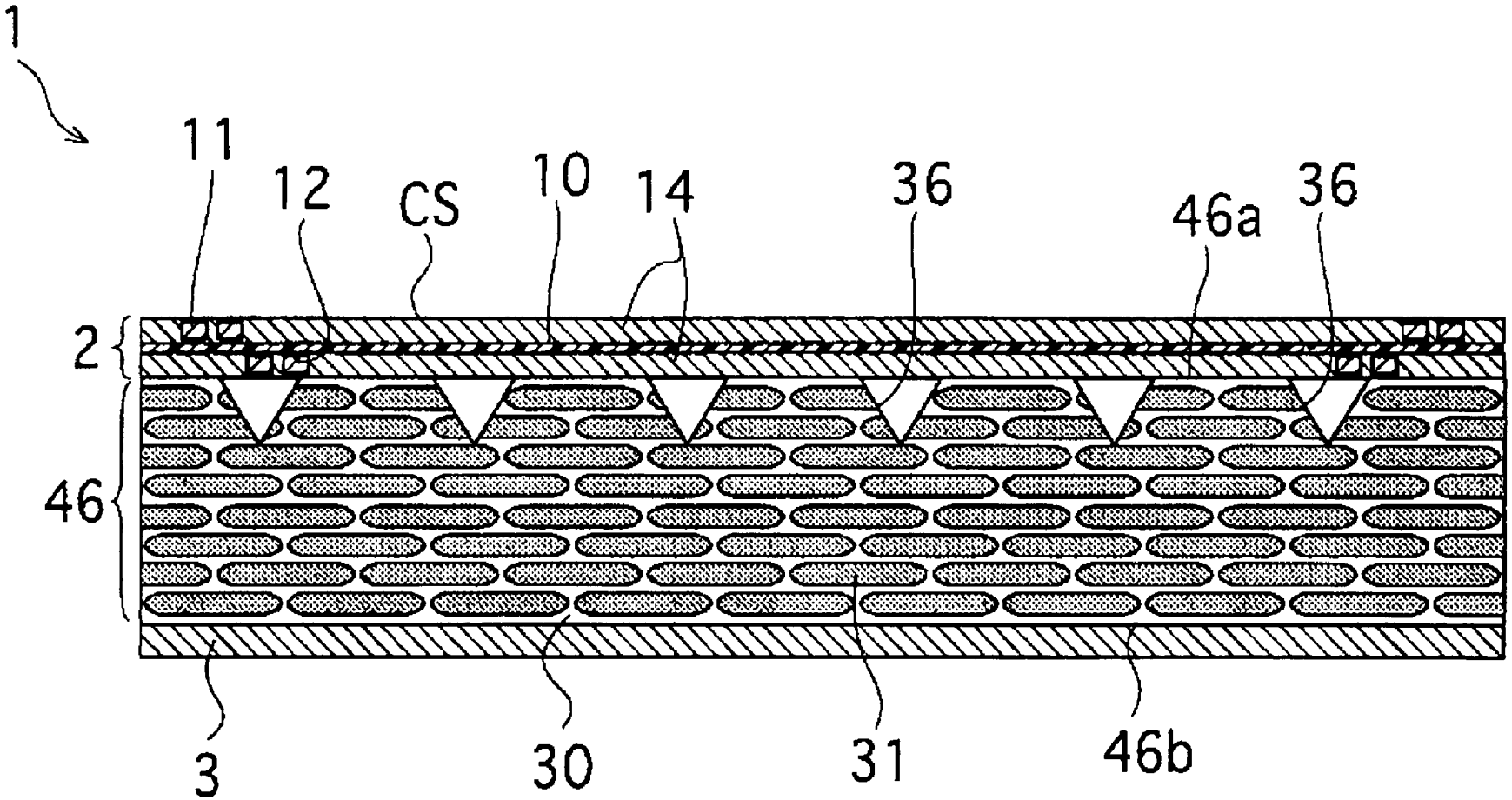
FIG. 12 is a schematic sectional view of an antenna module 1 showing a modified example of FIG. 10.

Note that the machined marks are not limited to the slits 35A having the above-mentioned configuration, but may include depressions 36 having a substantially V-shaped cross section such as shown in, e.g., FIG. 12, whereby the first surface 46*a* is provided with an irregular surface with a gear-tooth-like pattern. Moreover, it may suffice that the depressions and projections in the first surface 46*a* are formed simultaneously with the molding of the magnetic core member 46 by using a die having a properly machined surface. Furthermore, an air layer formed by the depressions and projections between the first surface 46*a* and the antenna substrate 2 may be filled with an appropriate insulating material.

While the embodiments of the present invention have been described in the foregoing, the present invention is not, of course, limited to these embodiments, but various modifications may be possible on the basis of the technical ideas of the present invention.

For example, while the magnetic core member is configured to be a sheet having a uniform surface in the above embodiments, it suffices that the magnetic core member is at least interposed between the antenna coils and the shield plate. Therefore, the magnetic core member may alternatively be formed into an annular sheet in a manner corresponding to the loop-like shape of the antenna coils.

Furthermore, while the example in which two types of the first, second antenna coils 11, 12 are formed on the base film 10 as the antenna substrate 2 has been described in the above embodiments, the antenna substrate is not, of course, limited to this, but may be an antenna substrate having only one type of antenna coil formed therein. Furthermore, an embodiment may also be applicable, in which a signal processing circuit is formed by mounting an RFID IC chip and other electronic components on the same antenna substrate.

Figure 13:
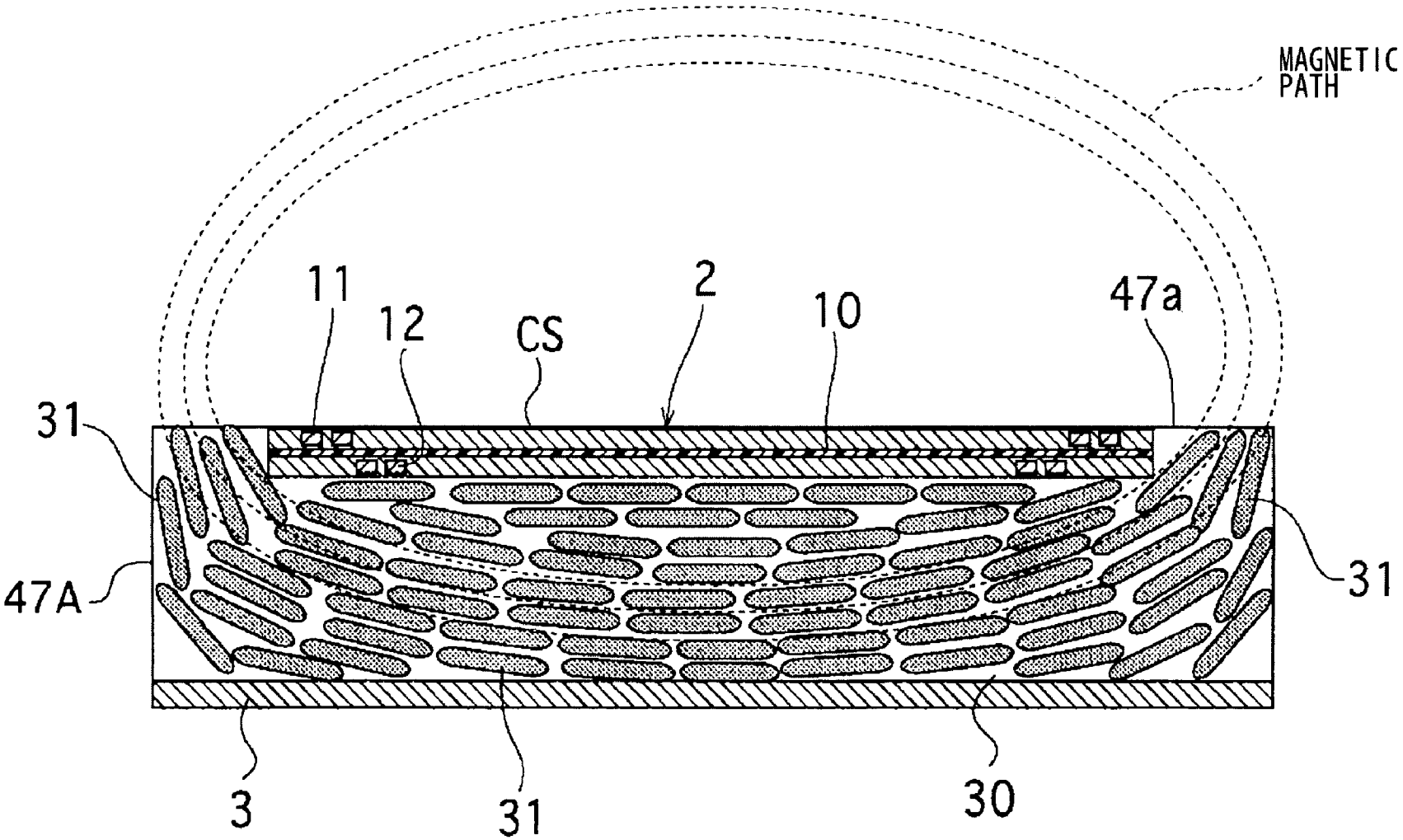
FIG. 13 is a schematic sectional view showing a modified example of the configuration of a magnetic core member.

Still furthermore, the configuration of the magnetic core member is not limited to the one in which the magnetic core member is laminated on a non-communication surface of the antenna substrate, but may include, as shown in, e.g., FIG. 13, a configuration in which an antenna substrate 2 is embedded in the surface of a magnetic core member 47A. In this case, in a first surface 47*a* of the magnetic core member 47A on a side opposed to the antenna substrate 2, a soft magnetic powder 31 for filling is aligned gradually upward at both end portions of the sheet such that a loop surrounding the antenna substrate 2 is formed so as to correspond to a direction of forming magnetic paths of an antenna-generated magnetic field, whereby it becomes possible to enhance the communication distance of the antenna coils 11, 12.

It is noted that another configuration example for aligning a soft magnetic powder so as to correspond to magnetic paths of an antenna-generated magnetic field as mentioned above, is shown in FIG. 14. A magnetic core member 47B shown in FIG. 14 has a soft magnetic powder 31 aligned to form a loop surrounding each antenna coil 11 (12) so as to correspond to a direction of forming magnetic paths of a magnetic field generated at the antenna coil on each of the left and right sides as viewed in the figure, in the first surface 47*a* opposed to the antenna substrate 2.

Figure 14:
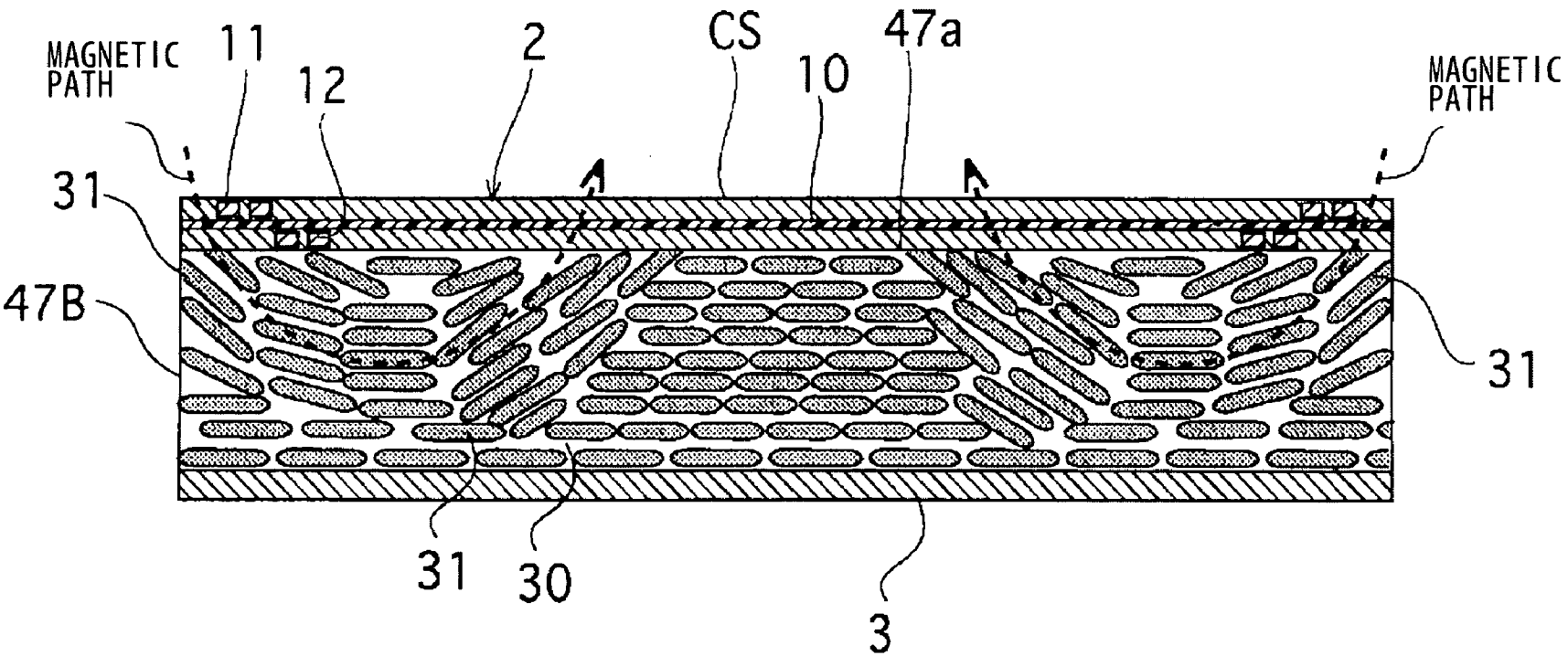
FIG. 14 is a schematic sectional view showing another modified example of the configuration of the magnetic core member.

In this example, although the magnetic field for communication formed on the communication surface CS of the antenna substrate 2 exhibits a manner shown in FIG. 13 macroscopically, the magnetic paths generated by the individual antenna coils are formed actually in a manner such as shown in FIG. 14. In view of this, advantages similar to those in the example shown in FIG. 13 can be obtained.

The invention claimed is:

1. A magnetic core member, which is formed by filling an insulating material with a magnetic powder, and which is sheet-shaped and disposed between an antenna coil formed by spirally winding wire in a plane and a conductive shield plate, characterized in that:

a first surface on a side opposed to the antenna coil and a second surface on a side opposed to the shield plate have magnetic properties different from each other.

2. The magnetic core member according to claim 1, characterized in that a filling rate of the magnetic powder in the first surface is lower than a filling rate of the magnetic powder in the second surface.

3. The magnetic core member according to claim 1, characterized in that the magnetic powder in the first surface is aligned in a direction perpendicular to a sheet surface, whereas the magnetic powder in the second surface is aligned parallel to the sheet surface.

4. The magnetic core member according to claim 1, characterized in that the magnetic powder in the first surface and the magnetic powder in the second surface are different in shape.

5. The magnetic core member according to claim 1, characterized in that machined marks are formed in the first surface.

6. The magnetic core member according to claim 1, characterized in that the first surface has an irregular shape.

7. An antenna module including an antenna coil formed by spirally winding wire in a plane, a conductive shield plate, and a sheet-shaped magnetic core member which is disposed between the antenna coil and the shield plate and is formed by filling an insulating material with a magnetic powder, characterized in that:

the magnetic core member has:

a first surface on a side opposed to the antenna coil and a second surface on a side opposed to the shield plate, which have magnetic properties different from each other.

8. The antenna module according to claim 7, characterized in that a filling rate of the magnetic powder in the first surface is lower than a filling rate of the magnetic powder in the second surface.

9. The antenna module according to claim 7, characterized in that the magnetic powder in the first surface is aligned in a direction perpendicular to a sheet surface, whereas the magnetic powder in the second surface is aligned parallel to the sheet surface.

10. The antenna module according to claim 7, characterized in that the magnetic powder in the first surface and the magnetic powder in the second surface are different in shape.

11. The antenna module according to claim 7, characterized in that machined marks are formed in the first surface.

12. The antenna module according to claim 7, characterized in that the first surface has an irregular shape.

13. A portable communication terminal having an information communication function to be performed via a communication network and incorporating an antenna module including an antenna coil formed by spirally winding wire in a plane, a conductive shield plate, and a sheet-shaped magnetic core member which is disposed between the antenna coil and the shield plate and is formed by filling an insulating material with a magnetic powder, characterized in that:

the magnetic core member has a first surface on a side opposed to the antenna coil and a second surface on a side opposed to the shield plate, which have magnetic properties different from each other.

14. The portable communication terminal according to claim 13, characterized in that a filling rate of the magnetic powder in the first surface is lower than a filling rate of the magnetic powder in the second surface.

15. The portable communication terminal according to claim 13, characterized in that the magnetic powder in the first surface is aligned in a direction perpendicular to a sheet surface, whereas the magnetic powder in the second surface is aligned parallel to the sheet surface.

16. The portable communication terminal according to claim 13, characterized in that the magnetic powder in the first surface and the magnetic powder in the second surface are different in shape.

17. The portable communication terminal according to claim 13, characterized in that machined marks are formed in the first surface.

18. The portable communication terminal according to claim 13, characterized in that the first surface has an irregular shape.

* * * * *

UNITED STATES PATENT AND TRADEMARK OFFICE

CERTIFICATE OF CORRECTION

PATENT NO. : 7,405,709 B2
APPLICATION NO. : 10/569900
DATED : July 29, 2008
INVENTOR(S) : Isao Takahashi, Kazuo Nozawa and Hiraku Akiho It is certified that error appears in the above-identified patent and that said Letters Patent is hereby corrected as shown below:

ON THE TITLE PAGE

"(86) PCT No.: PCT/JP2004/012783

§371 (c) (1),
(2), (4) Date: Feb. 28, 2004"

should be

--(86) PCT No.: PCT/JP2004/012783

§371 (c)(1),
(2), (4) Date: Feb. 28, 2006--

Signed and Sealed this

Twenty-third Day of September, 2008

JON W. DUDAS
*Director of the United States Patent and Trademark Office*